US006234915B1

(12) United States Patent
Wu

(10) Patent No.: US 6,234,915 B1
(45) Date of Patent: May 22, 2001

(54) THREE-PIECE GOLF PUTTER

(76) Inventor: Kun-Jung Wu, No. 77, Tung-Ling Rd., Ta-Shu Hsiang, Kaohsiung Hsien (TW)

( * ) Notice: Subject to any disclaimer, the term of this patent is extended or adjusted under 35 U.S.C. 154(b) by 0 days.

(21) Appl. No.: 09/345,006

(22) Filed: Jul. 2, 1999

(51) Int. Cl.[7] ..... A63B 53/02

(52) U.S. Cl. ..... 473/248; 473/305; 473/292; 473/313; 473/307; 473/312

(58) Field of Search ..... 473/305, 306, 473/307, 308, 309, 310, 311, 312, 313, 314, 315, 329, 332, 340, 342, 246, 248, 292, 288, 324, 251, 244

(56) References Cited

U.S. PATENT DOCUMENTS 5,116,047 * 5/1992 Phelan .
5,292,128 * 3/1994 Solheim .
5,332,214 * 7/1994 Tucker .
5,377,979 * 1/1995 Long .
5,407,196 * 4/1995 Busnardo .
5,511,779 * 4/1996 Meyers .
5,542,675 * 8/1996 Micciche .
5,577,726 * 11/1996 Fenton .
5,580,051 * 12/1996 Fisher .

* cited by examiner

*Primary Examiner*—Sebastiano Passaniti
(74) *Attorney, Agent, or Firm*—Dougherty & Troxell

(57) ABSTRACT

A three-piece golf putter comprises a putter head, an anti-shock slat, and a neck. The neck made of a material differs from that of the putter head and the anti-shock slat in specific gravity. So that, by replacing the neck with different specific gravity or different angle of elevation, the center of gravity may be adjusted to the best position to match with various striking postures. Moreover, by selecting the anti-shock slat in different specific gravities, depth of the center of gravity may be changed in order to enlarge region of the sweet spot for easy grasp.

1 Claim, 13 Drawing Sheets

THREE-PIECE GOLF PUTTER

BACKGROUND OF THE INVENTION

A suitable golf club to a golfer is something just like a good brush to a painter, both require delicate skills that can only be accumulated and upgraded by constant practice.

As the putting green is usually the main battlefield, in addition to skill and experience, a suitable putter is also an advantageous weapon in competition for award. Besides the material a putter is made of, a low gravity center in same height with ball center is considered a must for the putter to enable a player to putt at the so-called sweet spot. Most of the golf putters employed so far are of two-piece ensemble, which are briefly described with annexed diagrams as below:

1. FIG. 1 shows a golf putter in two-piece ensemble of putter head 1 and neck 10. A plurality of tapped bores 11 is aligned in the putter head 1 for screw-fixing the neck 10 by selecting one of the bores 11 before inserting a shaft 12 in the neck 10 to eliminate offset of the center of gravity A of the putter head 1 (shown in FIG. 2). However, there can be only 2 or 3 adjustable bores 11 available owing to limited space of the putter head 1 that is insufficient to fit the individuals.

2. FIG. 3 indicates another example of golf putter in two-piece ensemble by combining a putter head 2 and a neck 20.

The neck 20 is screw-fixed in the putter head 2 before inserting a shaft 21, and because the center of gravity A can not be adjusted, hence, it fails to fit players widely despite of the curved neck 20 that is designed for various striking postures and habits.

3. According to FIG. 5, a further example of golf putter in two-piece ensemble by combining a neck 30 and a putter head 3 before coupling with a shaft 31. In this case, the unadjustable center of gravity A locates at an upper level than the center of gravity B of a golf ball as shown in FIG. 6.

4. An additional balance weight is usually added to the putter head in order to have the center of gravity fixed to the best position, which cannot be easily changed further on the spot, so that a player has to prepare extra putters when he alters his striking posture.

In view of the above-described imperfections, after years of constant effort in research, the inventor of this invention has consequently developed and proposed this improved mechanism pertaining to the subject matter.

SUMMARY OF THE INVENTION

This invention relates to a three-piece golf putter, particularly to a putter having a neck made of a material in different specific gravity with its putter head and anti-shock slat in order to raise up or lower down the center of gravity, wherein the neck can be replaced easily for different specific gravity or angle of elevation so as to adjust the center of gravity and grasp the sweet spot when a player is to change his striking posture.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THIS INVENTION

The primary object of this invention is to provide a three-piece golf putter, wherein the center of gravity in its putter head is adjustable for fitting various striking postures and facilitating grasp of the sweet spot.

Figure 1:
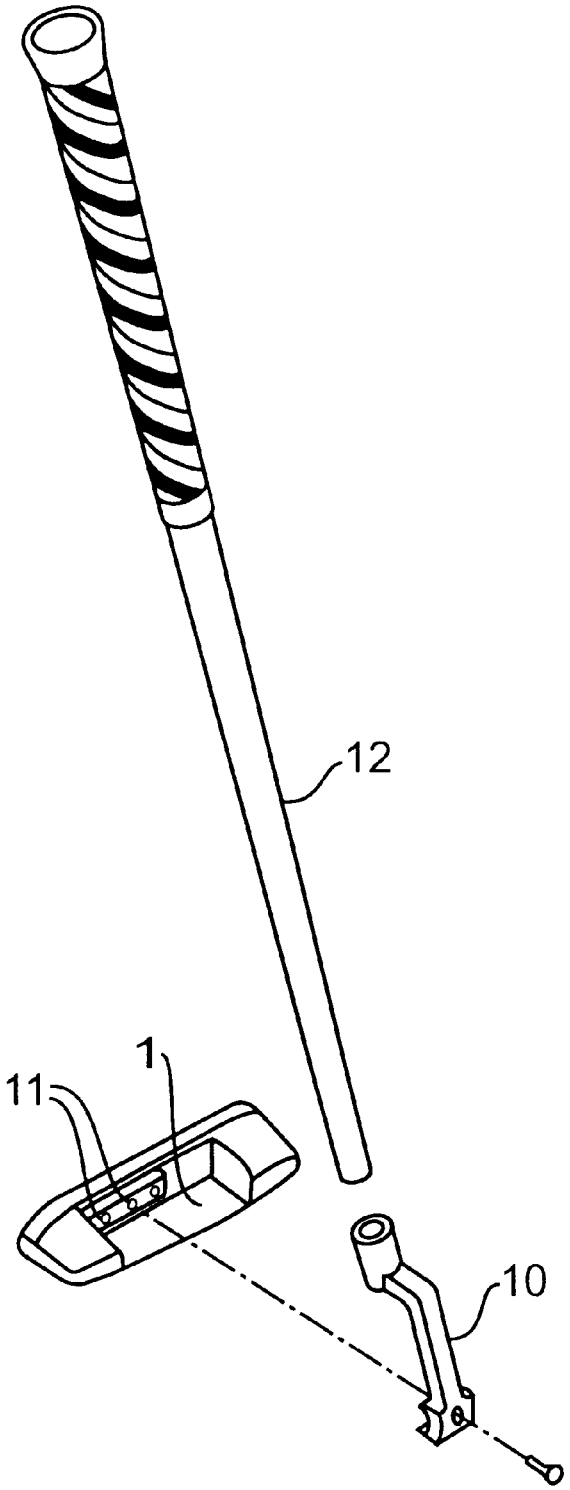
FIG. 1 PRIOR ART
FIG. 1 is a three-dimensional exploded view of a prior golf putter (1)
Figure 2:
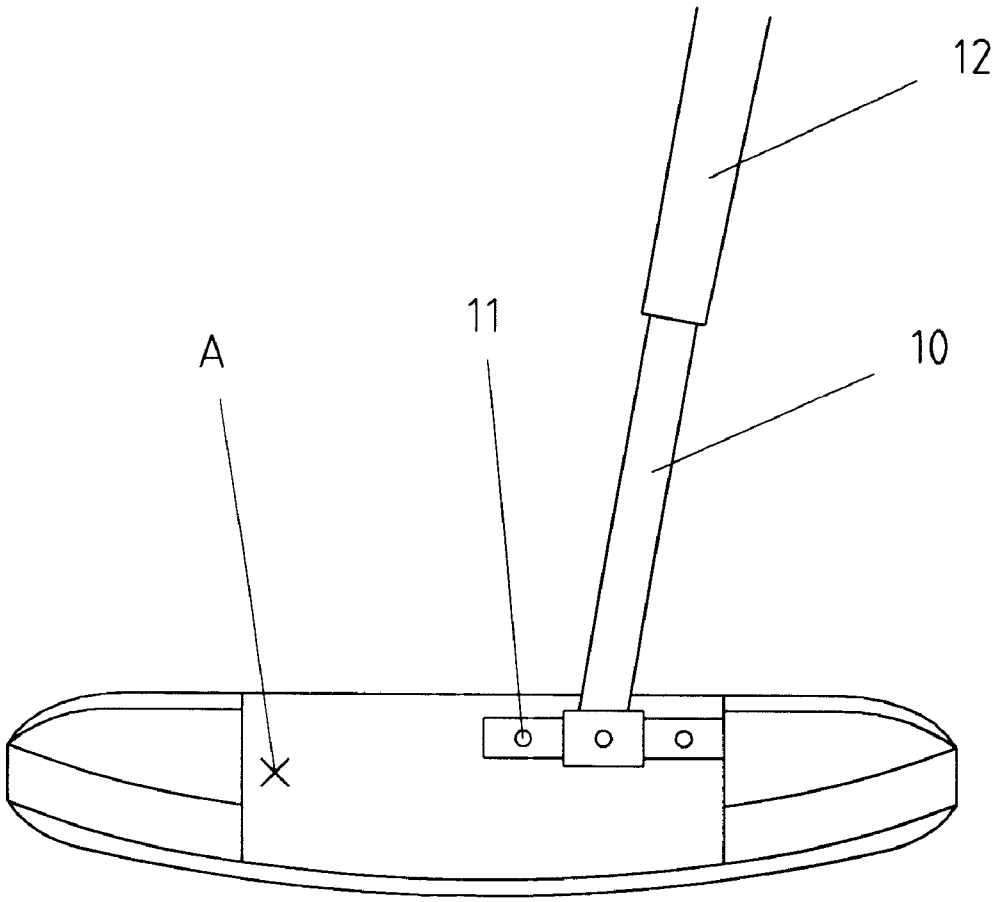
FIG. 2 PRIOR ART
FIG. 2 is a schematic view showing the center of gravity of the prior golf putter of FIG. 1.
Figure 3:
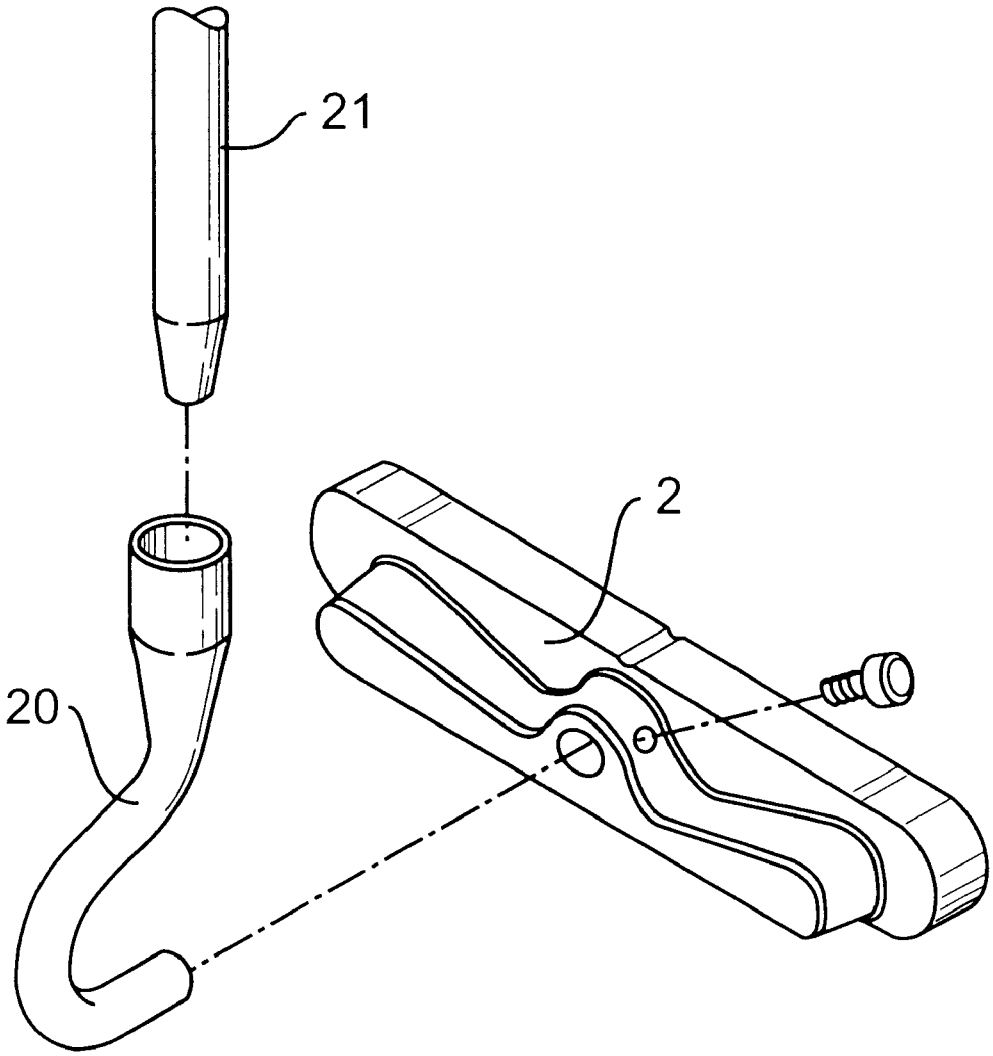
FIG. 3 PRIOR ART
FIG. 3 is another three-dimensional exploded view of a prior golf putter.
Figure 4:
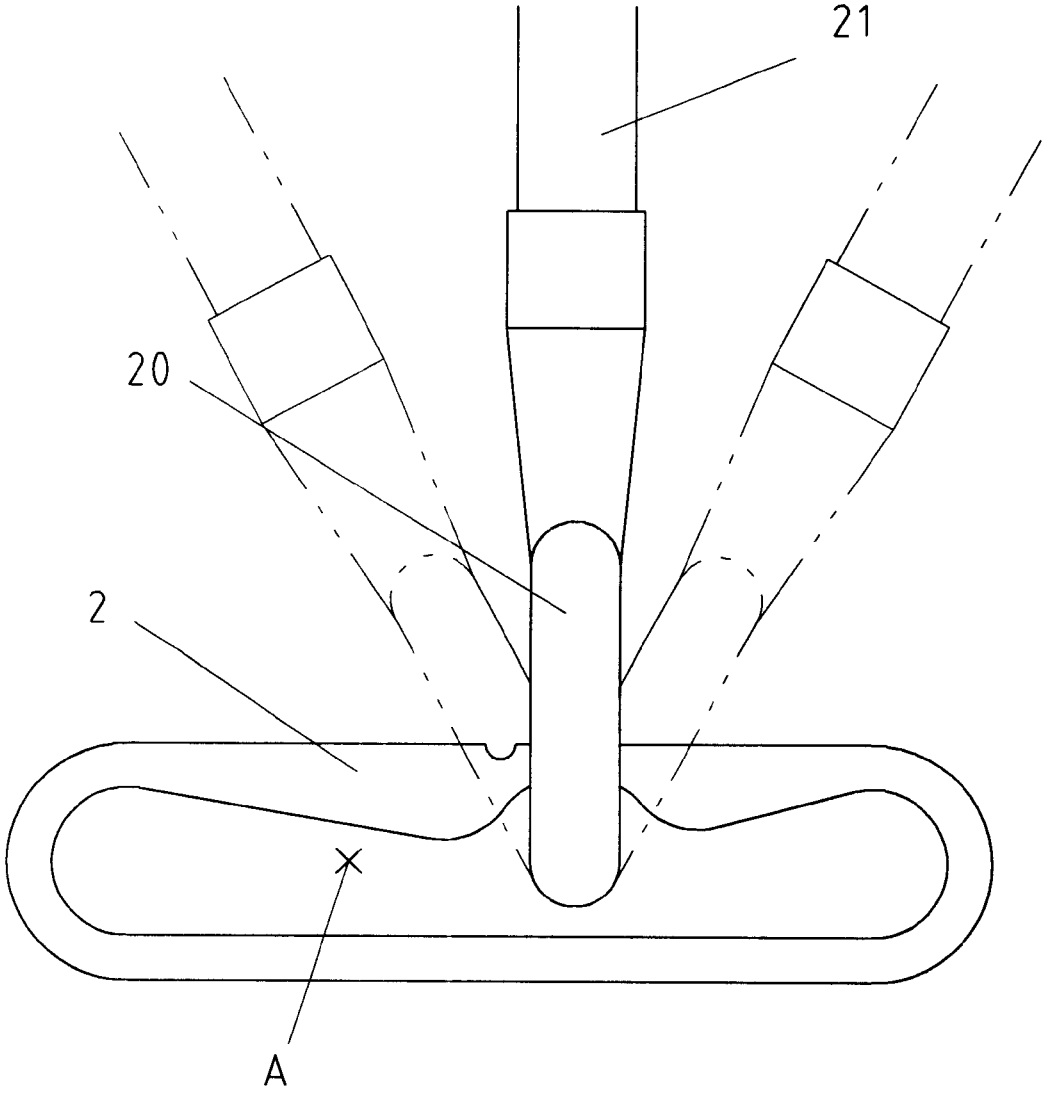
FIG. 4 PRIOR ART
FIG. 4 is a schematic view showing the center of gravity of the prior golf putter of FIG. 3.
Figure 5:
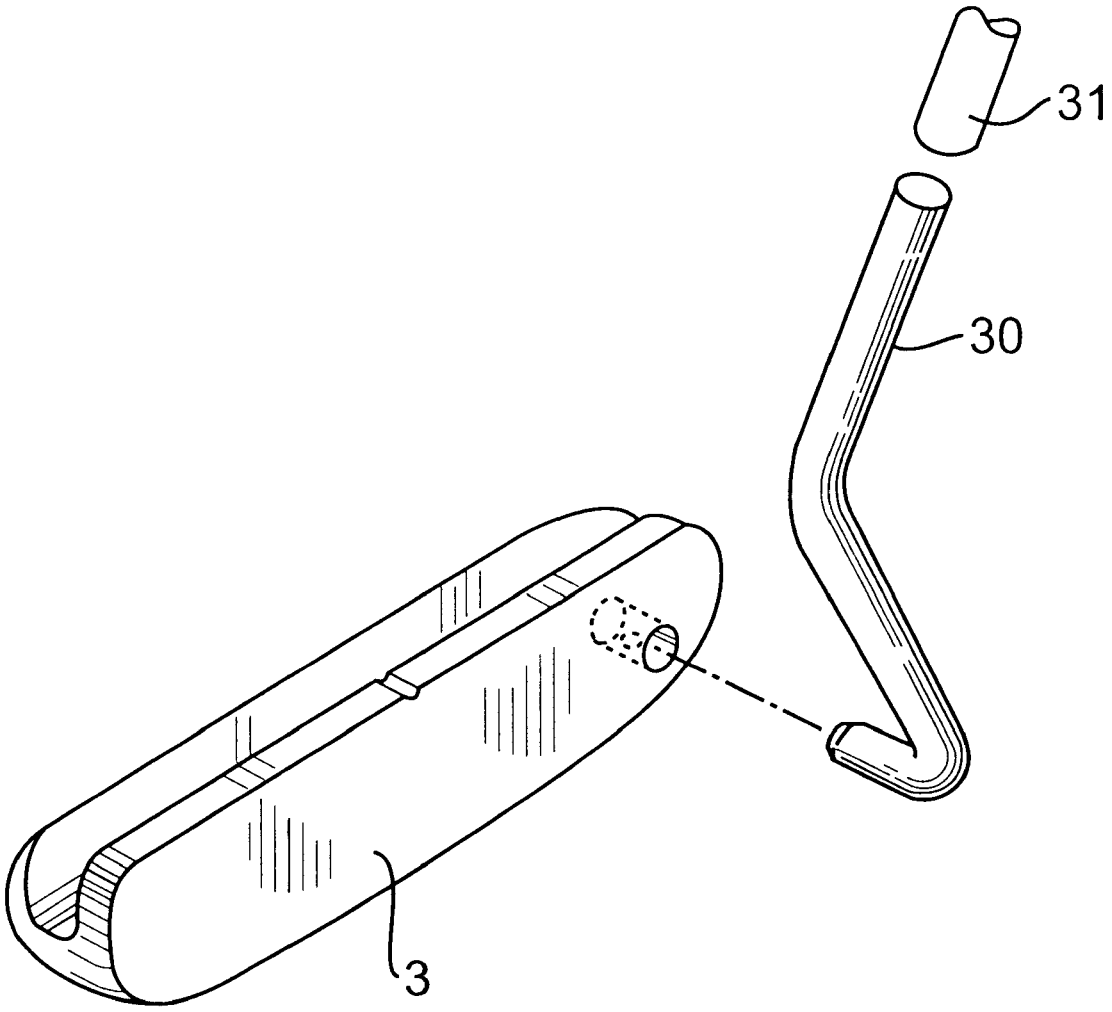
FIG. 5 PRIOR ART
FIG. 5 is another three-dimensional exploded view of a prior golf putter.
Figure 6:
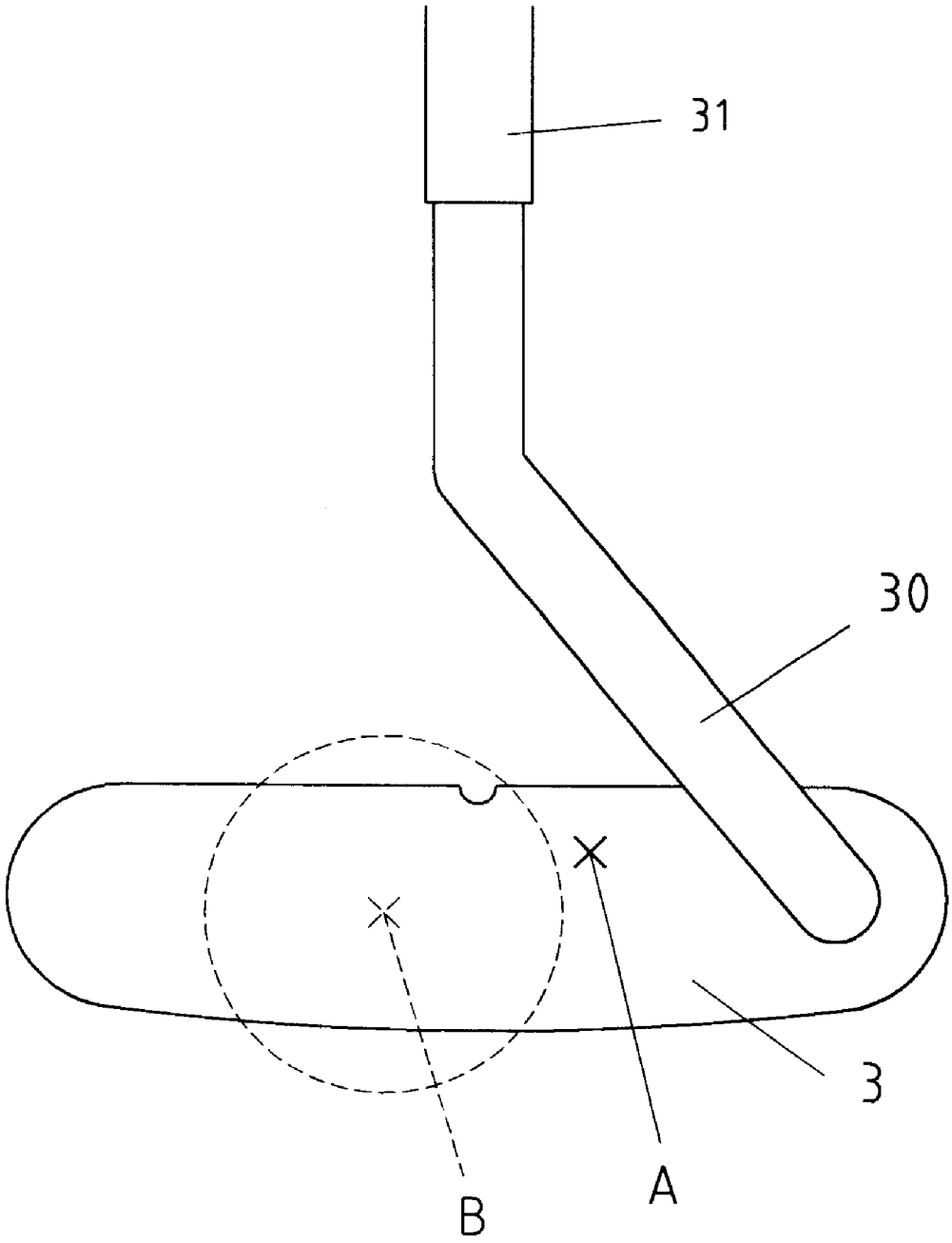
FIG.6 PRIOR ART
FIG. 6 is a schematic view showing the center of gravity of the prior golf putter of FIG. 5 as well as that of a golf ball.
Figure 7:
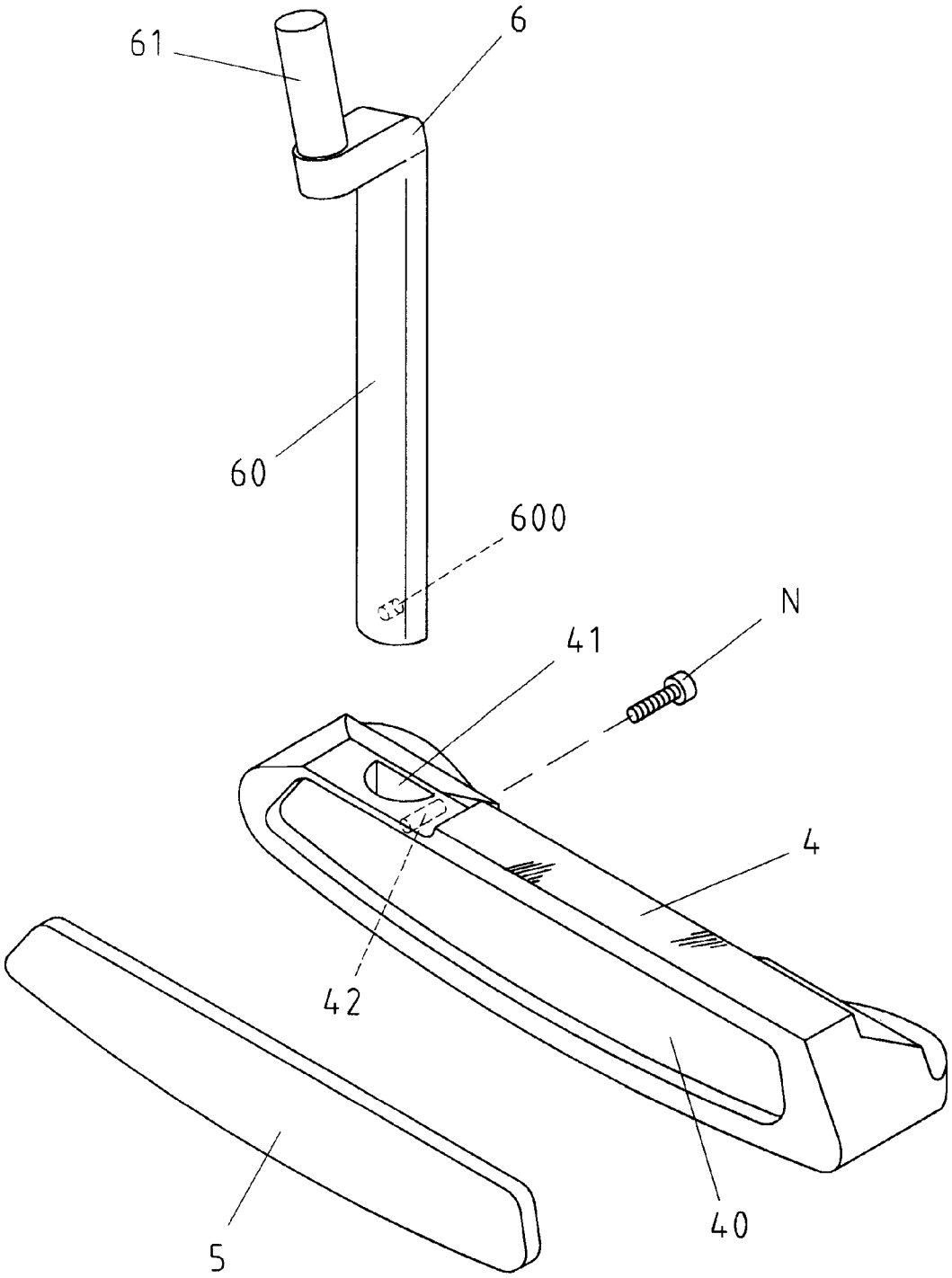
FIG. 7 is a three-dimensional exploded view of this invention.

With regard to abovesaid object and efficacy of this invention, at least a preferred embodiment will be elucidated with annexed diagrams as below:

Firstly, as shown in FIG. 7, this invention mainly contains a metallic putter head 4, comprising: a concave coupling portion 40, an insertion receptacle 41, an anti-shock slat 5, and a neck 6. The concave coupling portion 40 and the insertion receptacle 41 are formed in the front face and at a lateral end of the putter head 4 respectively, wherein a tapped through hole 42 is arranged in the insertion receptacle 41. The anti-shock slat 5 is inserted in the concave coupling portion 40, and the neck 6 screw-jointed to the insertion receptacle 41 can be made of a single material or compound of plastics, carbon fibers, ABS, aluminum, or titanium, etc, for example, an alloy or a metallic material invested by a rubber layer. Further, the material utilized in the neck 6 differs from that of the putter head 4 and the anti-shock slat 5 in specific gravity. The neck 6 further comprises an insertion rod 60 at its lower portion with a tapped through hole 600 near its bottom end, and a fixing portion 61 located on its top end.

Figure 8:
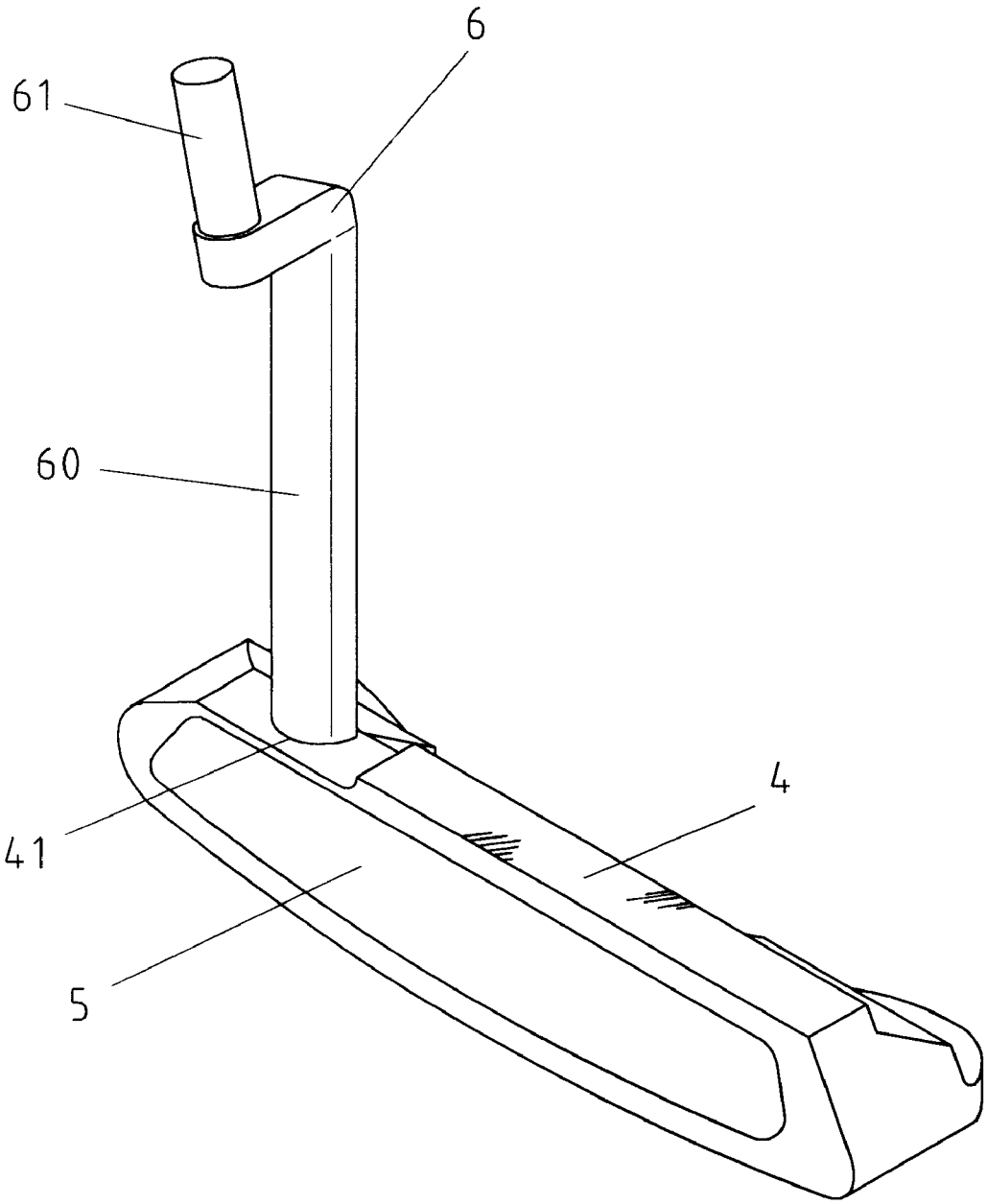
FIG. 8 is a three-dimensional assembled view of this invention.
Figure 9:
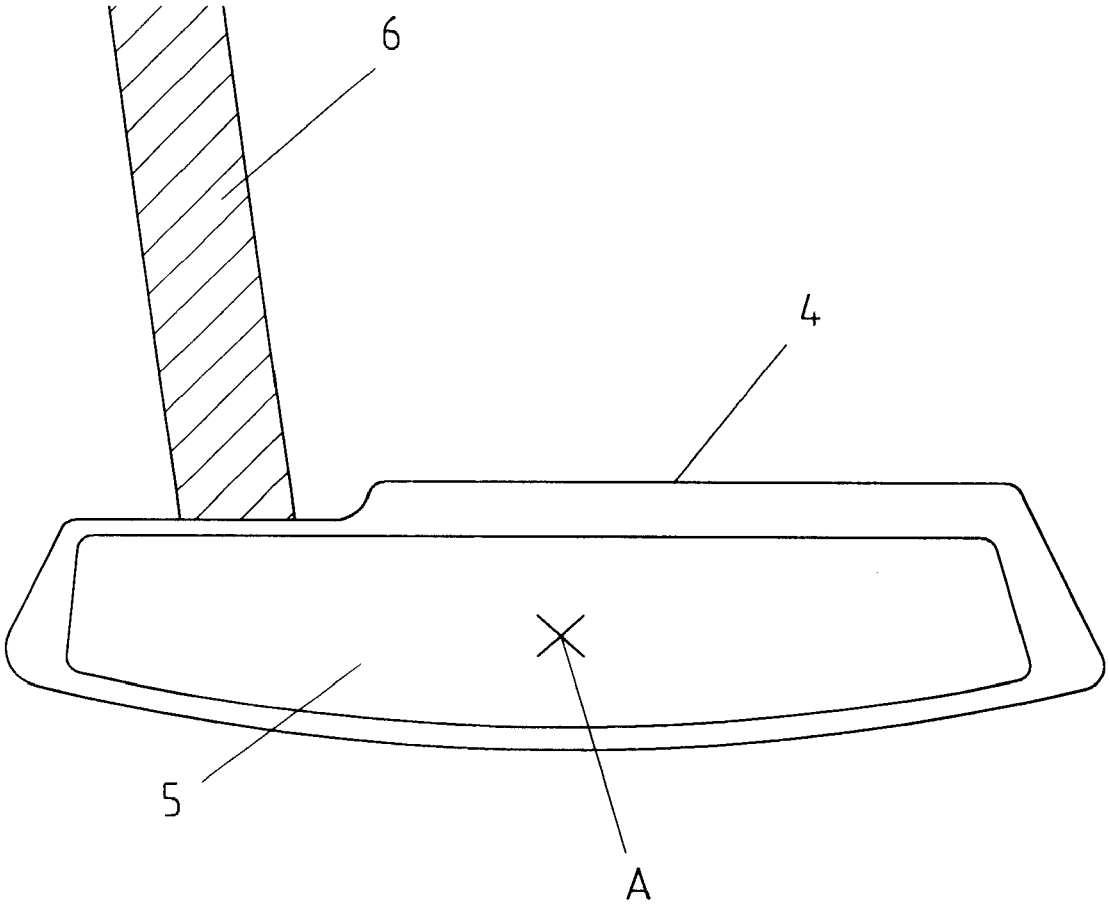
FIG. 9 is a schematic view showing replacement of a neck for adjusting the center of gravity of this invention.
Figure 10:
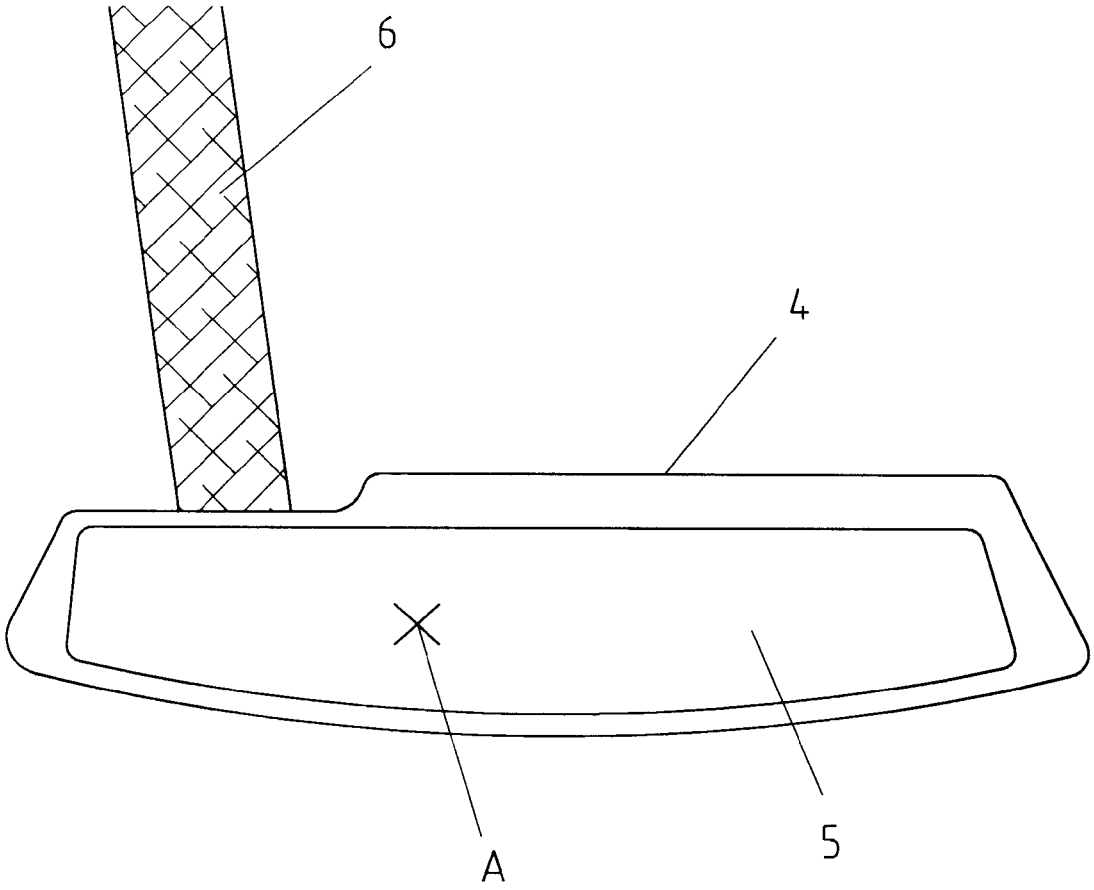
FIG. 10 is another schematic view showing replacement of the neck for adjusting the center of gravity of this invention.
Figure 11:
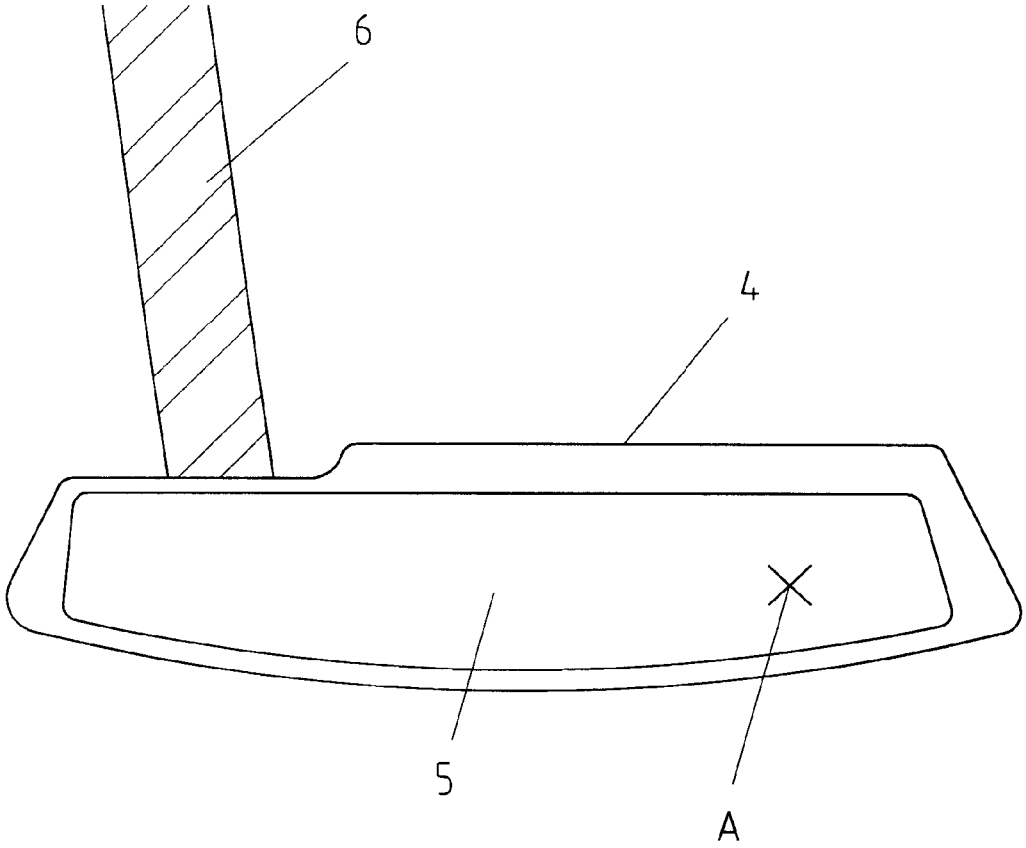
FIG. 11 is another schematic view showing replacement of the neck for adjusting the center of gravity of this invention.
Figure 12:
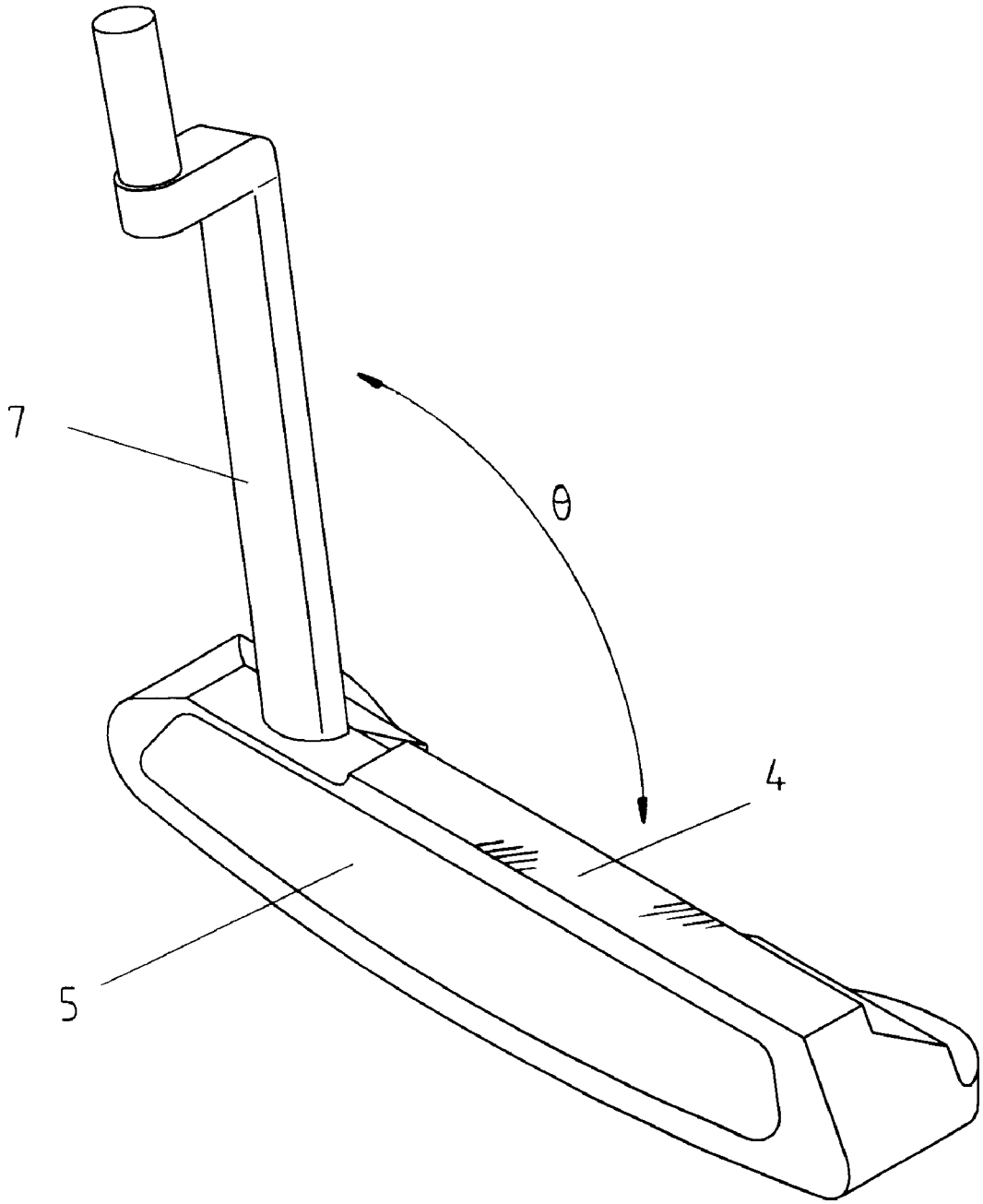
FIG. 12 is a schematic view showing replacement of the neck of this invention for a different angle of elevation.
Figure 13:
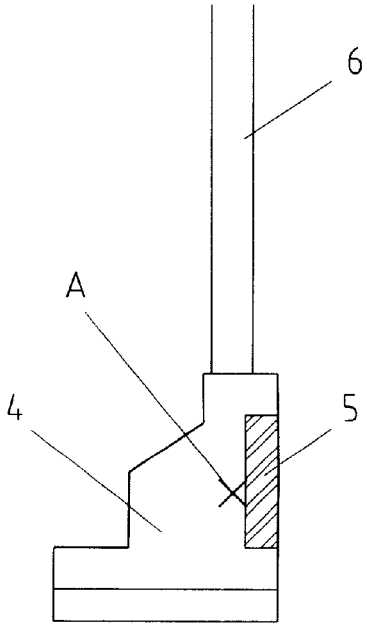
FIG. 13 is a schematic view showing replacement of an anti-shock slat of this invention for adjusting the center of gravity.
Figure 14:
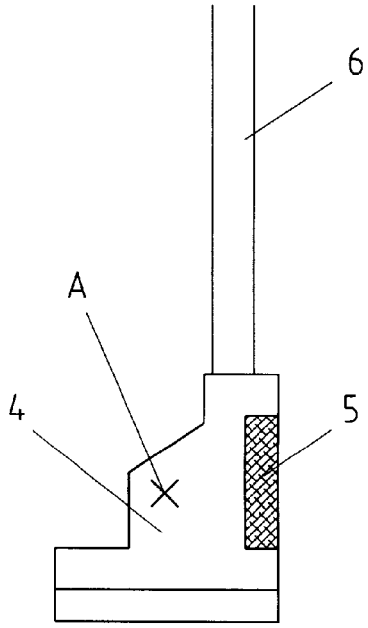
FIG. 14 is other schematic view showing replacement of an anti-shock slat of this invention for adjusting the center of gravity.

When assembling, as shown in FIG. 8, a user is supposed to insert the anti-shock slat 5 in the concave coupling portion 40 of the putter head 4, then put the insertion rod 60 of the neck 6 into the insertion receptacle 41 and fix it with a screw-joint component N. As the specific gravity of the neck 6 is lighter than that of the putter head 4, the center of gravity A can be lowered down with a relatively wider region of sweet spot for a beginner to grasp easily. Moreover, the neck 6 may be replaced with another neck in different specific gravity as shown in FIG. 9, 10, and 11 for adjusting the center of gravity A, where the range of specific gravity of the substitute is nothing concerned with space of the putter head 4; or replaced with another neck 7 in different angle of elevation θ (shown in FIG. 12) to meet requirements of the players in various statures. If adjustment of the center of gravity in depth is desired, it can be achieved by substituting another anti-shock slat 5 with a different specific gravity (shown in FIG. 13, 14) without needing any extra balance weight.

A further embodiment of this invention is to use a relatively heavier material for fabricating the neck 6 than that for the putter head 4 in order to raise up the center of gravity A in the putter head 4 for the golfers who prefer a putter with relatively higher center of gravity A to a lower one.

From the abovesaid, it is noted that this invention is advantageous in the following:

1. The neck of three-piece ensemble is replaceable for lowering down the center of gravity and for an easy grasp of sweet spot.

2. By replacing the neck with different specific gravity, matching with various striking postures is possible.

3. A wider region of sweet spot is obtainable for easy grasping.

4. Selection of the anti-shock slat with different specific gravities can adjust depth of the center of gravity.

5. No need of balance weight is favorable for lowering cost.

6. A relatively heavier neck may be selected for raising the center of gravity for people who prefer a putter with high center of gravity to a low one.

In the above described, at least one preferred embodiment has been elucidated with reference to relating drawings annexed, it is apparent that numerous variations or modifications may be made without departing from the true spirit and scope thereof, as set forth in the following claims.

What is claimed is:

1. A three-piece golf putter comprising:

a putter head having an upper portion, two lateral end portions, a front face and a concave coupling in said front face, a rear surface opposite from said front face and a concave insertion receptacle formed in said upper portion of one of said lateral end portions and said putter head including a tapped through hole extending from said rear surface of said putter head and into said concave insertion receptacle;

an anti-shock slat inserted in said coupling portion;

a one piece replaceable neck having an upper portion and a fixing portion in said upper portion for attachment to a golf shaft and a lower portion including an insertion rod formed in said lower portion and said insertion rod including a tapped through hole which is adjacent to said tapped through hole in said putter head when said insertion rod is inserted into said concave insertion receptacle and a screw extending through said tapped holes to fix said replaceable neck to said putter head; and said replaceable neck being made of a metallic material invested by a rubber layer and being replaceable by a different neck having a different angle of elevation and different specific gravity to accommodate different players.

* * * * *